US006896605B2

(12) United States Patent
Ohlendorf

(10) Patent No.: US 6,896,605 B2
(45) Date of Patent: May 24, 2005

(54) GRINDING TOOL WITH EXTRACTION HOOD

(75) Inventor: Oliver Ohlendorf, München (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/315,782

(22) Filed: Dec. 10, 2002

(65) Prior Publication Data

US 2003/0119435 A1 Jun. 26, 2003

(30) Foreign Application Priority Data

Dec. 20, 2001 (DE) ..... 101 62 632

(51) Int. Cl.[7] ..... B24B 55/06
(52) U.S. Cl. ..... 451/454; 451/359
(58) Field of Search ..... 451/456, 454, 451/359, 353

(56) References Cited

U.S. PATENT DOCUMENTS 3,256,648 A * 6/1966 Subonovich ..... 451/456
3,673,744 A * 7/1972 Oimoen ..... 451/456
3,824,745 A 7/1974 Hutchins
4,622,782 A 11/1986 Roestenberg
5,005,321 A * 4/1991 Barth et al. ..... 451/454

FOREIGN PATENT DOCUMENTS

| | | | |
|---|---|---|---|
| DE | 2539762 | 3/1977 | |
| EP | 1074341 | 7/2001 | |
| JP | 55-112759 | * 8/1980 | ..... 451/359 |
| JP | 57-211467 | * 12/1982 | ..... 451/359 |

* cited by examiner

*Primary Examiner*—Robert A. Rose
(74) *Attorney, Agent, or Firm*—Sidley Austin Brown & Wood, LLP

(57) ABSTRACT

A grinding tool comprising a housing (1) and a motor-driven driver spindle (2) equipped with a tool receptacle (4) at a free end (3) projecting from the housing (1). An extraction hood (5) is connected to the housing (1), encloses the free end (3) of the driver spindle (2) and open towards the tool receptacle (4). The extraction hood (5) comprises an upper part (6) and a bottom part (7) connected therewith and opening towards the tool receptacle (4). The upper part (6) is pivotable about the longitudinal axis (L) of the driver spindle (2) and is mounted on the housing (1) immovably oriented with the longitudinal direction (L).

6 Claims, 2 Drawing Sheets

GRINDING TOOL WITH EXTRACTION HOOD

BACKGROUND OF THE INVENTION

Figure 1:
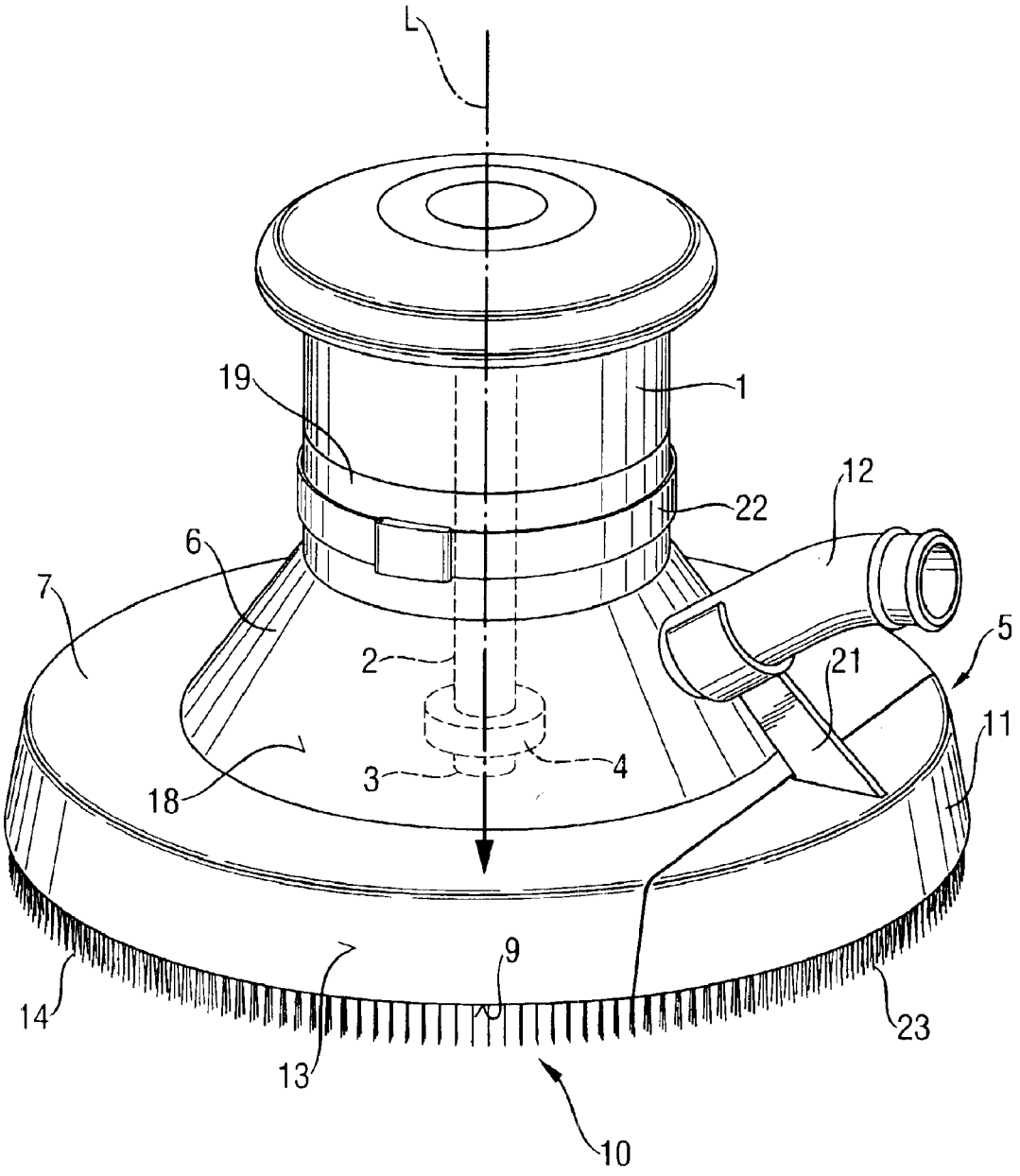

The invention relates to a grinding tool comprising a housing and a motor-driven driver spindle having a free end, projecting from the housing. A tool receptacle is provided on the free end and on the housing. An extraction hood abuts the housing, encloses the free end and opens towards the tool receptacle. The extraction hood comprises a top portion and a bottom portion that adjacent thereto that opens towards the tool receptacle.

Grinding tools of the above type comprise an extraction hood for suctioning away from the work zone of the grinding tool the particle, in particular dust particles, that are abrasively removed from a surface to be worked by a motor-driven tool.

EP215476 discloses a grinding tool comprising a housing and a motor-driven driver spindle, at whose free end projecting from the housing, a tool receptacle is disposed. An extraction hood abuts the housing and encloses the free end of the driver spindle, opening towards the tool receptacle. The extraction hood comprises a top portion and a bottom portion abutting thereon that opens towards the tool receptacle.

The drawback in the known solution is that the grinding tool cannot be adequately used in an edge area bordering the surface to be worked, because the lower portion prevents positioning in the immediate vicinity of the surface. Dismantling of the extraction hood from the rest of the grinding tool not only represents considerable effort on the part of the operator but also using the grinding tool without the extraction hood, particularly for a concrete surface, results in an unacceptable stressing of the environment and the operator by the particles removed.

SUMMARY OF THE INVENTION

The object of the present invention is to provide a grinding tool with an extraction hood that enables working of difficult to reach surfaces and satisfactory extraction performance.

The object is achieved according to the invention by a bottom part that comprises at least one recess opening towards the free end, whose extended plane runs transverse to the longitudinal direction of the driver spindle and corresponds to 0.02 to 0.1 times the suction opening surrounded by the free end of the bottom part.

It is possible to position the grinding tool in the zone near a framed-in marginal zone to be worked and to work the entire, framed-in marginal surface since the bottom part comprises a peripheral recess. It is also necessary that the recess not be of overly large dimensions in relation to the extraction opening to assure adequate extraction performance. The smaller the opening, the better the extraction performance; an opening that is configured too small, however, prevents complete working of the surface in the zone of the marginal surface.

The plane extended by the recess preferably runs transverse to the longitudinal direction of the driver spindle. As a result, optimal extraction performance, in particular, in flat marginal zones running substantially perpendicular to the surface, are possible. On the one hand, a tool being used can be brought up to the marginal surface and, on the other hand, a seal can be established between the marginal surface and the peripheral recess, in contact with the bottom part of the marginal zone.

The recess can be advantageously closed to assure maximum extraction performance in a grinding operation of a surface lying outside of the framed-in area.

Preferably, the cover part is pivotally mounted relative to the bottom part to allow easy closing and opening of the recess. Naturally, the cover part can be used as a regulating mechanism for extraction performance. In this particular application, the recess of the bottom part is only partially closed by the cover part.

Advantageously, the cover part can be rotated on the housing to assure precise guiding of the cover part.

Preferably, the bottom part is rotatably mounted on the housing to enable positioning of the recess relative to the housing. The operator is able to position the housing relative to the bottom part, in particular to the recess, depending on the configuration of the outer contour of the housing.

The cover part is advantageously rigidly mounted on the housing, in particular, in the zone of the steering handle of the grinding tool, to assure easy handling.

The cover part is preferably configured complementary to the recess to assure compact construction of the cover part. Naturally, depending on conditions, a variant geometry is also possible; for example, forming the cover part as a ring.

The bottom part can be advantageously pivoted relative to the upper part substantially about the longitudinal axis of the driver spindle to assure optimal positioning of the two parts relative to each other. Particularly, when the upper part comprises extraction nozzles that can be connected with the vacuum source, this embodiment is advantageous, since the two parts are displaceable relative to each other, in particular, such parts can be pivoted.

The upper part is preferably pivotal relative to the housing about the longitudinal axis of the driver spindle to enable adjustment of the upper part relative to the housing.

BRIEF DESCRIPTION OF THE INVENTION

Figure 2:
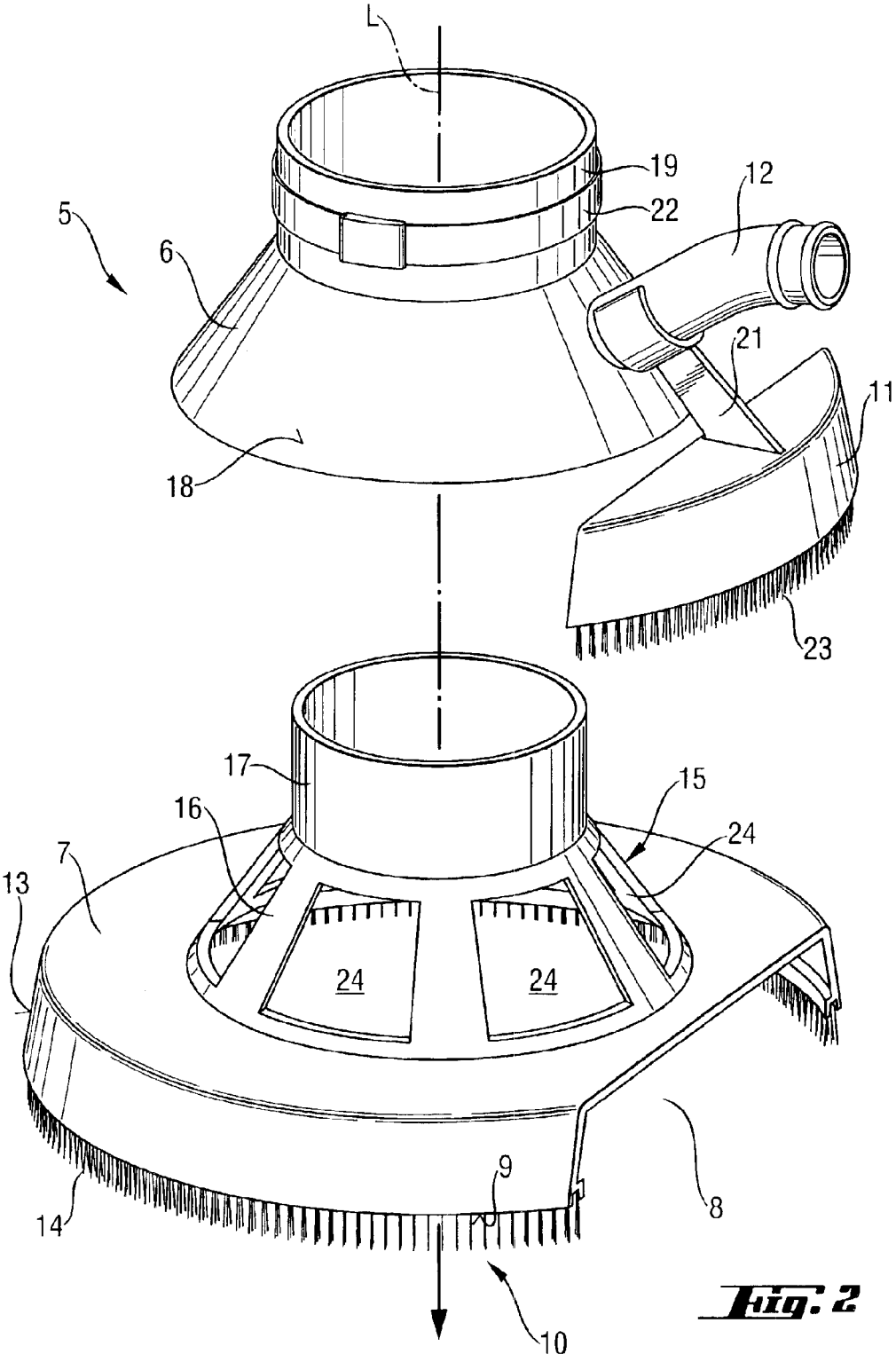

The invention will be more completely described below using an exemplary embodiment, wherein:

FIG. 1 represents a perspective view of a grinding tool according to the invention; and FIG. 2 represents a perspective view of the extraction hood of FIG. 1, in the pre-assembled state.

DETAILED DESCRIPTION OF THE PREFERRED EMBODIMENTS

FIGS. 1 and 2 shows a grinding tool according to the invention comprising a housing 1 and a motor-driven driver spindle 2, projecting from the housing 1, on which a tool receptacle 4 is disposed at a free end 3 of the driver spindle 2. An extraction hood 5 abuts the housing 1 enclosing the free end 3 and opens towards the tool receptacle 4. The extraction hood 5 comprises an upper part 6 and a bottom part 7 abutting thereon and opening towards the tool receptacle 4.

The upper part 6 has a truncated conical outer contour 18 that is pivotable about a longitudinal axis L of the driver spindle 2 and is fixedly mounted in the longitudinal direction L on the housing 1. An externally protruding extraction nozzle is disposed on an outer contour 18 by a vacuum source (not shown herein) connected with an inner space formed by the extraction hood 4. The upper part 6 comprises a mounting part 19 on a side facing away from the tool receptacle 4, in the longitudinal direction L of the driver spindle 2.

The bottom part 7, which is provided with a cylindrical shell surface 13, comprises a recess opening towards the free end 3 transverse to the longitudinal axis L of the driver spindle 2. The plane or surface extended by the recess 8 corresponds to 0.07 times the extraction opening 10 enclosed by a free end 9 of the bottom part 7. The plane covered by the recess 8 runs transverse to the longitudinal axis L of the driver spindle 2. A cover part 11 can be attached, for example, by a snap-on fastening to the bottom part 7 enabling closing of the recess 8 and assuring maximal extraction performance. Furthermore, the cover part 11 is essentially complementary to the recess 8. The bottom part 7 comprises, at the free end 9, a dust curtain, for example, an annular brush fringe 14 extending in the longitudinal direction L, that frames the free end 9 of the bottom part 7. Advantageously, the annular brush fringe 14 is manufactured of a resilient material. The extraction hood 5 further comprises an extraction assembly 15, which enables a pivotable and axial mounting of the upper part 6 and the bottom part 7 on the housing 1. The extraction assembly 15 further comprises a truncated conical cage member 16 and a tubular configured mounting member 17 abutting the side of the cage member 16 facing away from the tool receptacle 4 and oriented in the longitudinal axis L, said mounting member co-operating with the mounting part 19 of the upper part. Advantageously the bottom part 7 connects with the side of the cage member 16 facing the tool receptacle in the longitudinal L orientation and is formed integral with same. In this fashion, the bottom part 7 is mounted non-rotationally and fixedly in the longitudinal direction L on the extraction assembly 15. The cage member 16 equipped with cut-outs 24 serves in bearing the upper part 6 and comprises the same inclination on the outside of same.

The housing 1 comprises a tubular receiving part oriented in the longitudinal direction L facing the tool side (not represented herein for clarity), which co-operates with the mounting member 17. The bottom part 7 and the cage member 16 can be assembled friction-lockingly and/or form-lockingly on the housing 1 using a clamping element 22 disposed on the outer contour of the mounting par 19 of the upper part 6 the entire extraction hood, in particular the upper part 6. The clamping element 22 comprises, for example, a gripping lever mechanism for detachably fastening the upper part 6 and the lower part 7 on the housing.

The cylindrically segment-shaped cover part 11 is connected with the upper part 6 by a connecting web 21, in particular, a resilient connecting web 21. The cover part 11 comprises a dust curtain, for example, a brush fringe 23 at its front side facing in the direction of the free end 9. In a further embodiment (not represented) the cover part 11 is tubular in form and can be pivoted on the bottom part 7 and/or mounted on the cage member 16. The recess 8 can be closed by pivoting the cover part 11 relative to the bottom part 7.

What is claimed is:

1. A grinding tool comprising a housing (1); and a motor-driven driver spindle (2) having a tool receptacle (4) at a free end (3) projecting from the housing (1) for supporting a grinding disc; and an extraction hood (5) connected to the housing (1), enclosing the free end (3) of the driver spindle (2) and opening towards the tool receptacle (4), said extraction hood (5) comprising an upper part (6) and a bottom part (7) connected therewith opening towards the tool receptacle (4), wherein the bottom part (7) comprises at least one recess (8) open towards the free end (3) with a coverage plane running transverse to the longitudinal axis (L) of the driver spindle (2) that corresponds to 0.02 to 0.1 times an extraction opening (10) enclosed by a free end (9) of the bottom part (7), wherein the coverage plane covered by the recess (8) runs transverse to the longitudinal axis (L) of the driver spindle (2), wherein the recess (8) is closed by a cover part (11) pivotally mounted relative to the bottom part (7), wherein the bottom part (7) is rotatably mounted on the housing (1) and is pivotable relative to the upper part (6) about the longitudinal axis (L) of the driver spindle (2) and wherein the cover part (11) is connected to the upper part (6).

2. The grinding tool of claim 1, wherein the cover part (11) is rotatably mounted on the housing (1).

3. The grinding tool of claim 1, wherein the cover part (11) is rigidly mounted on the housing (1).

4. The grinding tool of claim 1, wherein the cover part (11) is complementarily to the recess (8).

5. The grinding tool according of claim 1, wherein the upper part (6) is pivotable relative to the housing (1) about the longitudinal axis (L) of the driver spindle (2).

6. The grinding tool of claim 1, wherein the upper part (6) has an extraction nozzle (12).

* * * * *